US005573231A

United States Patent [19]

Stab

[11] Patent Number: 5,573,231

[45] Date of Patent: Nov. 12, 1996

[54] FOLDING APPARATUS

[75] Inventor: Rudolf Stab, Frankenthal, Germany

[73] Assignee: Albert-Frankenthal Aktiengesellschaft, Frankenthal, Germany

[21] Appl. No.: 356,722

[22] Filed: Dec. 15, 1994

[30] Foreign Application Priority Data

Dec. 15, 1993 [DE] Germany ..... 43 42 718.9
Dec. 24, 1993 [DE] Germany ..... 43 44 364.8

[51] Int. Cl.[6] ..... B41F 13/06; B65H 45/28

[52] U.S. Cl. ..... 270/43; 226/197; 226/21

[58] Field of Search ..... 270/4, 5, 8, 10, 270/20.1, 21.1, 41, 42, 43, 12, 45, 47, 49, 50; 226/20, 21, 197; 493/417, 424, 425, 426, 427, 428; 198/481.1, 483.1

[56] References Cited

U.S. PATENT DOCUMENTS

| | | | |
|---|---|---|---|
| 673,312 | 4/1901 | Bechman | 493/359 |
| 2,506,053 | 5/1950 | Zuckerman | 270/18 |
| 3,556,509 | 1/1971 | Crum | 270/52 |
| 3,679,116 | 7/1972 | Hamlin et al. | 226/119 |
| 3,734,487 | 5/1973 | Treft | 270/10 X |
| 4,779,859 | 10/1988 | Knauer | 270/41 |
| 4,957,280 | 9/1990 | Motooka | 270/50 X |
| 5,016,863 | 5/1991 | Birkmair | 270/5 X |
| 5,048,810 | 9/1991 | Palmatier et al. | 270/43 X |
| 5,176,371 | 1/1993 | Rau et al. | 270/5 X |
| 5,413,039 | 5/1995 | Sohma | 226/197 X |
| 5,439,206 | 8/1995 | Raasch et al. | 270/8 |

FOREIGN PATENT DOCUMENTS

| | | |
|---|---|---|
| 1 039 538 | 9/1958 | Germany . |
| 36 28 411 | 2/1988 | Germany . |

OTHER PUBLICATIONS

Patent Abstracts Of Japan; Pub. No. JP57180550; App. No. JP-810061236 Dated Apr. 24, 1981; vol. 7, No. 25.

*Primary Examiner*—John E. Ryznic
*Attorney, Agent, or Firm*—Jones, Tullar & Cooper, P.C.

[57] ABSTRACT

A folding apparatus for a rotary printing machine utilizes a plurality of belt guide systems to retain signatures against the surfaces of the collecting, folding and gripper cylinders of the folding apparatus. The position of a longitudinal folder or of a turning bar or bars can be shifted in the axial direction of the collecting cylinder at least the width of one belt to align at least one longitudinal edge of the signatures with one of the belts in the belt guide system. The grippers on the collecting cylinder will engage the leading edge of the signatures without damaging them.

3 Claims, 5 Drawing Sheets

FOLDING APPARATUS

FIELD OF THE INVENTION

The present invention is directed generally to a folding apparatus. More particularly, the present invention is directed to a folding apparatus having a collecting cylinder equipped with gripper systems and a cooperating folding jaw cylinder. Most specifically, the present invention is directed to a folding apparatus having a plurality of belt guide systems for the signatures to be guided and wherein the paper web train, which will be cut into signatures is shiftable axially with respect to the collecting cylinder. When the width of the signatures to be guided to and through the collecting cylinders and the folding jaw cylinder is less than the maximum possible width, the position of the signatures can be shifted axially with respect to the collecting and folding blade cylinders. This shifting will be done to align at least one of the longitudinal side edges of the signatures with one of the plurality of belts in the belt guide system.

DESCRIPTION OF THE PRIOR ART

In web-fed rotary printing presses a web of paper is printed. The printed webs from several printing units in a printing press will then typically be superimposed to form a paper web train and will then be directed to one or more longitudinal formers or to one or more turning bars. The now longitudinally folded or turned paper webs train is fed into a folding apparatus where it is initially cross cut into signatures and is then cross folded by the action of a folding jaw or folding flap cylinder which cooperates with a collecting cylinder. It is generally well known to utilize a plurality of belt guide systems in such folding apparatuses to guide the signatures or subsequent products around the individual cylinders. These belt guide systems conventionally are comprised of a number of spaced, generally parallel belts that are disposed about a series of rollers on a plurality of shafts. One such belt guide system is shown in German Patent Publication No. DE 36 28 411 A1. In this prior art device, the belts in the belt guide system partially loop around the circumferences of all of the cylinders disposed in the folding apparatus and help to support the products and to move them along to the paddle wheel and sheet delivery.

The belts of the typical belt guide system are disposed in cooperation with the collecting cylinder in a typical folding apparatus in such a way as to be spaced axially between the axially spaced grippers in each gripper shaft. This spacing allows the signatures to be gripped by the grippers on the collecting cylinder while still being supported by the belts of the belt guide system.

The typical folding apparatus processes various width paper web trains. The width may vary between, for example, 200 mm to 500 mm. The paper web train that arrives at the folding apparatus from the turning bars by way of a longitudinal former may be a mixed paper web. The prior art folding apparatuses have not always been able to easily accommodate paper web trains having various paper web widths with the result being that in some instances the signatures have been damaged in the folding apparatus. Thus there is a need for a folding apparatus which will accommodate paper web trains made up of webs whose widths may vary. The folding apparatus in accordance with the present invention provides such a device and is a significant improvement over the prior art devices.

SUMMARY OF THE INVENTION

It is an object of the present invention to provide a folding apparatus.

Another object of the present invention is to provide a folding apparatus having a collecting cylinder and a folding blade cylinder.

A further object of the present invention is to provide a folding apparatus which utilizes a belt guide system.

Yet another object of the present invention is to provide a folding apparatus in which the position of the paper web train is shiftable axially.

Still a further object of the present invention is to provide a folding apparatus which uses an axially shiftable turning bar.

Even yet a further object of the present invention is to provide a folding apparatus having an axially shiftable longitudinal former.

As will be discussed in greater detail in the description of the preferred embodiment which is presented subsequently, the folding apparatus in accordance with the present invention includes a collecting cylinder that is provided with gripper systems and folding blades, and a folding jaw cylinder that has a plurality of folding jaws. A plurality of belt guide systems are utilized to guide the signatures to be folded or guided. Each belt guide system uses a plurality of axially spaced driven belts which are spaced over the entire width of the folding apparatus. The signatures to be folded or guided can have an effective width which may well be less than the maximum possible working width of the folding apparatus. In accordance with the present invention, the paper web train, before it enters a transverse cutting device, is shifted axially in the direction of the axes of rotation of the collecting cylinder and of the folding blade cylinder in such a way that at least one of the longitudinal edges of the signatures will be engaged by one of the belts of the belt guide system. The spacing between adjacent belts is preferably less than the width of the belts. The paper web train can be shifted axially by axial shifting of a turning bar or of a longitudinal former. A suitable computer and suitable sensing devices can be used to insure that the paper web train has been properly shifted.

The folding apparatus in accordance with the present invention insures that there is provided a variable folding apparatus which will accommodate various changes in the format width of the paper web train while insuring that the paper web will be properly handled and not damaged. The signatures will be guided and supported by the belt guide systems in such a way that their outer edges, or at least one of their outer edges will be engaged by one of the belts of the belt guide system. The outer edges of the signatures will extend parallel to the direction of conveyance of the belts in the belt guide system.

The folding apparatus in accordance with the present invention allows the selection of paper web widths and thus the width of the signatures within a pre-selected range in a manner such that each one of the two longitudinal edges of the paper web train, or of the signatures is covered at least half way by one of the belts of the belt guide system. The axial displacement capability of the turning bar or bars or of the longitudinal folder allows the paper web train to be shifted axially with respect to the collecting cylinder and the folding jaw cylinder. A support force is provided to each signature longitudinal edge by one of the belts of the belt guide system by proper positioning of the paper web train. In this way, damage to the front edges of the signatures by the grippers during the gripping operation is prevented. The same holds true when point stars instead of grippers are used as the signature leading edge gripping devices. In addition, when a stitcher is used in conjunction with the collecting cylinder, the folding apparatus in accordance with the present invention assures that the outside edges of the signatures are covered at least halfway by one of the belts of the belt guide system and that the stitches are disposed so that they are approximately centered in the straight line of the transverse fold which will subsequently be made.

The folding apparatus in accordance with the present invention overcomes the limitations of the prior art devices. It facilitates the accurate positioning of the paper web train, the proper support of the signatures and the production of a damage-free product. It is a substantial advance in the art.

BRIEF DESCRIPTION OF THE DRAWINGS

While the novel features of the folding apparatus in accordance with the present invention are set forth with particularity in the appended claims, a full and complete understanding of the invention may be had by referring to the detailed description of the preferred embodiment which is set forth subsequently, and as illustrated in the accompanying drawings, in which:

DETAILED DESCRIPTION OF THE PREFERRED EMBODIMENT

Figure 1:
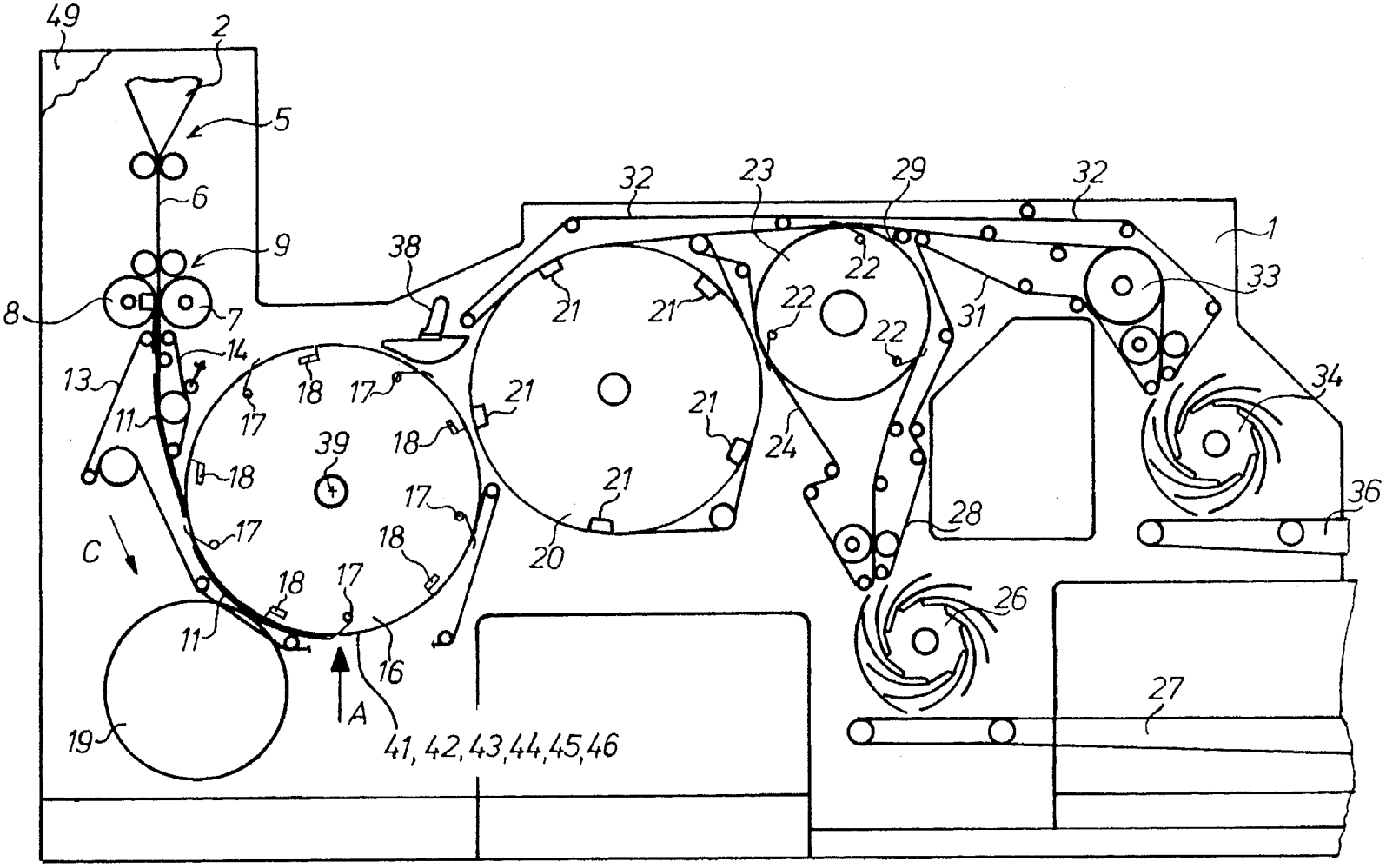
FIG. 1 is a schematic side elevation view of a folding apparatus in accordance with the present invention and showing two transverse folded product deliveries.

Referring initially to FIG. 1, there may be seen a preferred embodiment of a folding apparatus in accordance with the present invention. It will be understood that the folding apparatus is intended to be used as part of, and in cooperation with a generally well known and conventional rotary printing press which is typically web-fed. Since the printing apparatus does not form a part of the present invention, it will not be described in detail. As may be seen primarily in FIG. 1, and also in FIG. 2, the folding apparatus has two spaced side frames 1 and 49 which are arranged parallel to each other and which support for rotation the several cylinders that will now be discussed. The specific rotary supports for the cylinders and their specific drive assemblies do not form part of the present invention. Only one of the two side frames, frame 1, is depicted in full in FIG. 1.

Figure 2:
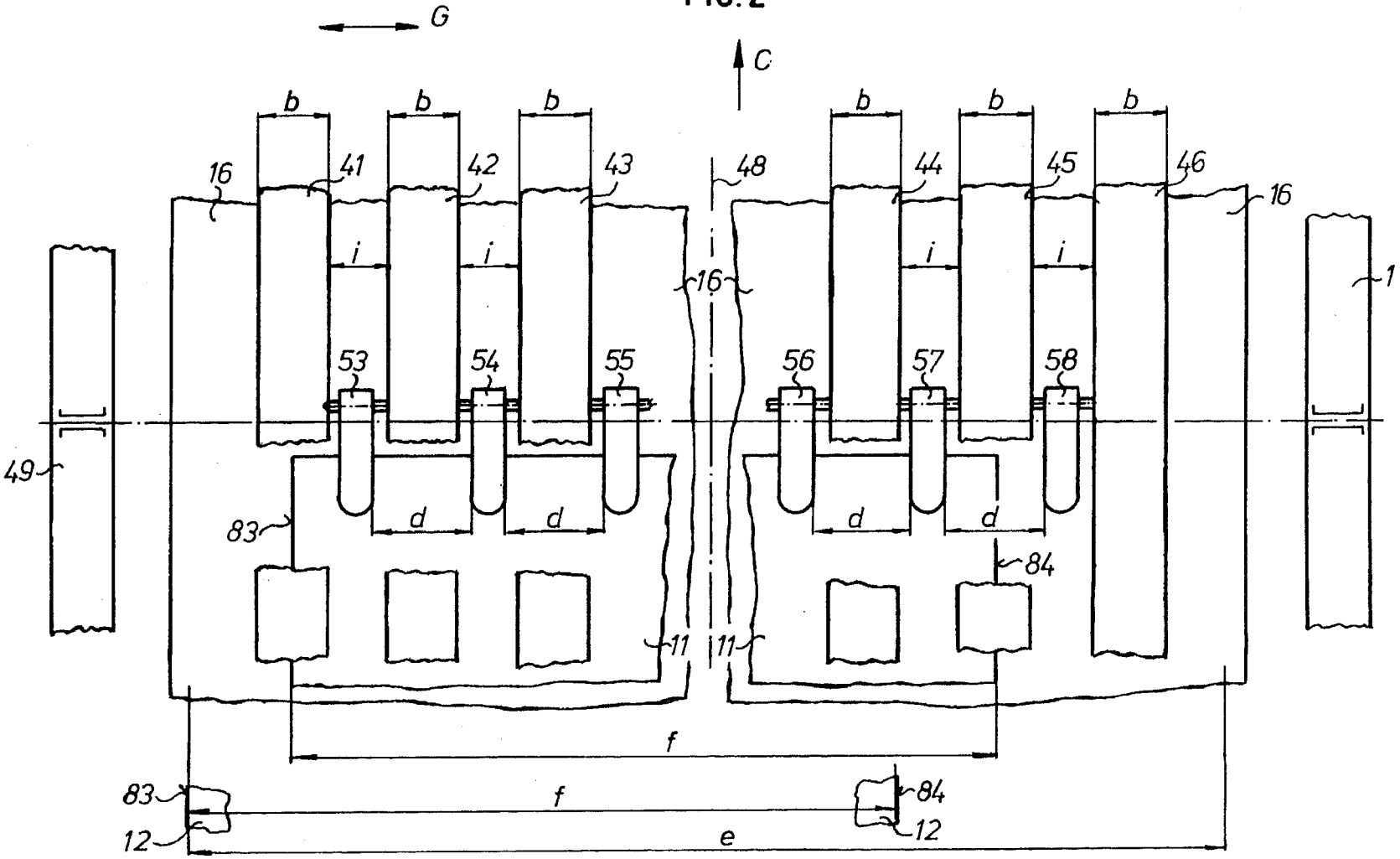
FIG. 2 is a bottom plan view of the collecting cylinder and its associated belt guide system of the present invention and looking in the direction A as indicated by the arrow in FIG. 1.
Figure 3:
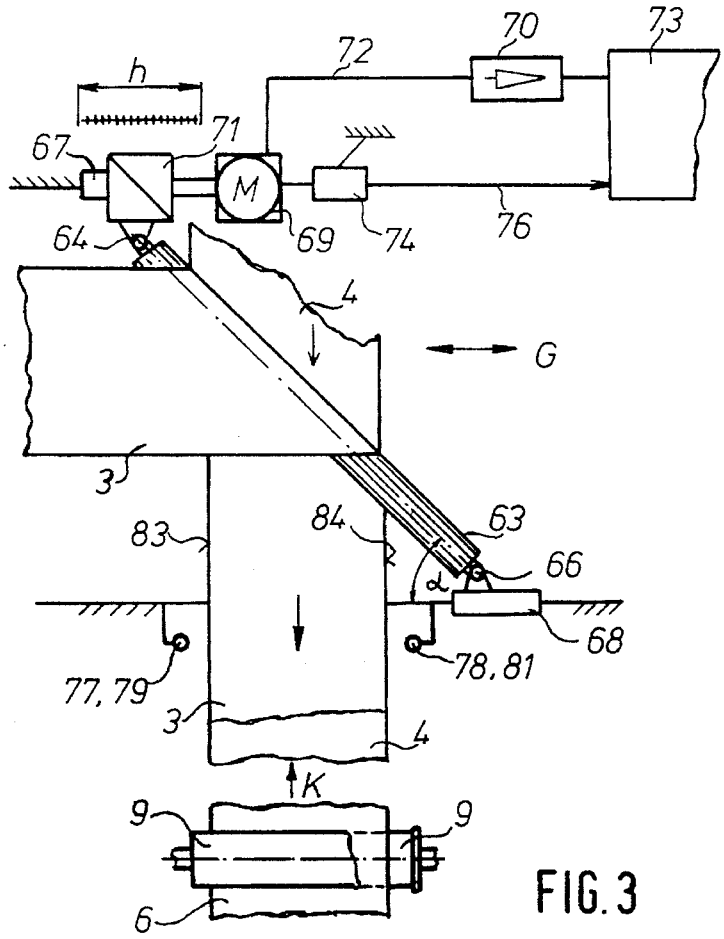
FIG. 3 is a schematic front elevation view of a portion of the folding apparatus in accordance with the present invention and showing an axially displaceable turning bar.

A somewhat schematically depicted longitudinal folding device 2, which includes a pair of folding rollers 5, receives a paper web train 6 which consists of several paper webs 3 and 4, as may also be seen in FIG. 3. This paper web train 6 passes through a transverse cutting device consisting of a transverse cutting cylinder 7 and a cutting groove cylinder 8 and having an upstream pair 9 of traction rollers. The paper web train 6 is cut by the transverse cutting device 7 and 8 into individual signatures 11 and 12 which are schematically depicted in FIG. 2, and which are moved by means of a belt guide system 13 and 14 to a five-piece or five field collecting cylinder 16. This collecting cylinder 16 is equipped, on its circumference, with five known gripper systems, respectively indicated by 17 as a whole, and with five folding blade systems, respectively indicated by 18. A stitcher 19, equipped with, for example, three stitching heads on its circumference can be selectively placed against the collecting cylinder 16. The belt guide system 13 continues to surround and support the signatures, not shown in FIG. 1, until they reach a five-piece or five field folding jaw cylinder 20 that is equipped with five known folding jaw systems 21 which are distributed over its circumference. A three-part gripper cylinder 23, equipped with three known gripper systems 22, is located after, in the direction of product travel, the folding jaw cylinder 20 and passes the transversely folded and possibly transversely stitched products by way of a belt guide system 24 that is disposed around the folding jaw cylinder 20 as well as around the gripper cylinder 23, to a first paddle wheel 26 with a first transverse fold delivery 27.

An additional belt guide system 31 and 32 is disposed behind the gripper cylinder 23. The folded products can alternatingly be supplied by means of a shunt 29 and the belt guide systems 31 and 32 by way of a deflection roller 33 to a second paddle wheel 34 and to a second transverse fold delivery 36. The belt guide system 32 contacts the circumference of the folding jaw cylinder 20 as well as the circumferences of the gripper cylinder 23 and the deflection roller 33 and extends to the second paddle wheel 34. A generally conventional paper guide device 38 can be positioned between the collecting cylinder 16 and the folding jaw cylinder 20 in the wedge behind the contact line of both cylinders 16, 20.

Turning now primarily to FIG. 2 there may be seen the right and left ends of a collecting cylinder 16 of the folding apparatus. The belt guide system 13 is provided as a plurality of generally parallel, spaced endless drive belts with belts 41, 42, 43, 44, 45 and 46 being depicted in FIG. 2. As is shown most clearly in FIG. 1, these belts 41–46 bear against the circumferential surface of the collecting cylinder 16, as may also be seen in FIG. 2. Each of the belts 41–46 has a width "b". A spacing or gap "i" is provided between each one of the belts and its adjoining belts. Preferably this gap or spacing width "i" is equal to or less than the width "b" of each of the belts 41–46. It will be understood that the belts 41–46 are representative of the total number of spaced belts which extend across the width of the collecting cylinder 16 and its cooperating cylinders. A centerline of the collecting cylinder 16 is illustrated by a line 48, which is viewed as extending in the production direction C. The side frames of the machine frame, in which journals (not shown) of the collecting cylinder 16 are seated, are indicated and identified by 1 and 49. The axis of rotation of the collecting cylinder 16 is indicated by 39. The belts 41 to 46 are guided on the jacket surface of the collecting cylinder 16 in spaces or areas "d" between adjoining grippers 53, 54, 55, 56, 57 and 58 of the gripper system 17. These grippers 53–58 are also intended to represent a plurality of grippers of the gripper system 17. The maximum width of a signature 11 or 12 which can be conveyed under the belt guide system 13 is indicated by "e". As may be seen in FIG. 2, this maximum width "e" is less than the axial width of the collecting cylinder 16.

The signatures 11 and 12, as symbolically indicated in FIG. 2, each have a width "f" which is less than the maximally possible width "e" of a signature. A minimum width "f" can be less than 200 mm, while the maximum width "e" can be more than 500 mm. In the prior art case, the indicated signature 12 would assume a normal or first position, such as a left justified position, viewed in the production direction C and taken in a view A from below on the collecting cylinder 16, wherein the long edges 83 and 84 of the left justified signature 12 are not arranged under any one of the belts 41 to 46. The signature 11 takes up a corrected or second position, in accordance with the present invention, as will be discussed in more detail shortly, in which the left and right longitudinal edges, 83 and 84 respectively, are each located beneath one of the belts 41–46 of the belt guide system. This positioning of the paper web or signature 11 will be accomplished in the manner as will now be discussed in detail.

Referring now to FIG. 3, there may be seen a turning bar 63, which can be displaced in an axial direction G parallel to the axis of rotation 39 of the collecting cylinder 16 and which is provided with a driving mechanism. This turning bar 63 is shown at an angle $\alpha$ of 45° in relation to the direction of the paper web travel, as seen in FIG. 3. The turning bar 63 is supported with both of its ends in sliding guides 67 and 68 by means of suitable hinge joints 64 and 66. One of the two sliding guides 67 and 68 can be driven, and can be connected in a non-positive and positive manner through the use of a unit consisting of a motor 69 and a gear 71, such as, for example, a pinion gear which engages a toothed rack fixed on the frame. The motor 69 is connected by a cable 72 and an amplifier 70 with a computer 73. One side of a potentiometer 74 which is fixed on the side frame 1 is connected with the motor 69 and the other side is connected via a cable 76 with the computer 73. The turning bar 63 can be displaced in the axial direction G over a range "h". The paper web 3 is guided over the turning bar 63 as shown, while the paper web 4 is fed in by means of a similar turning bar which is not specifically shown. A pair 9 of traction rollers are symbolically Schematically depicted in FIG. 3.

Figure 4:
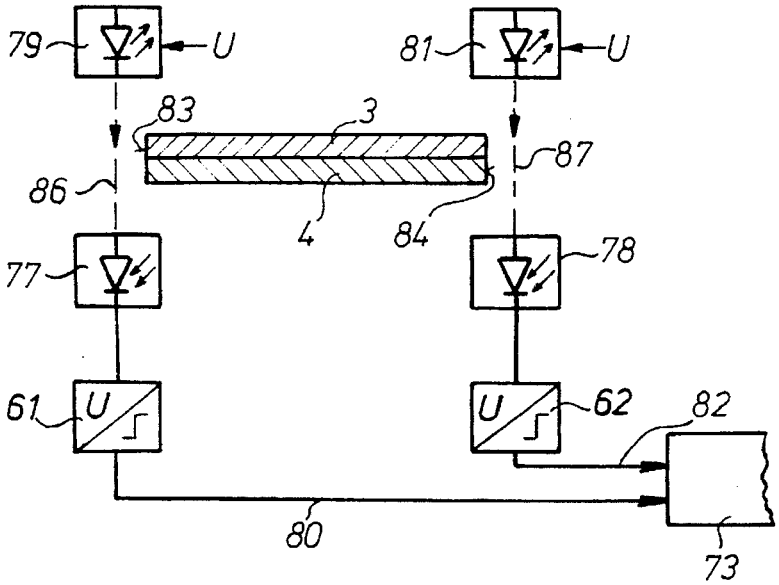
FIG. 4 is a bottom plan view of the apparatus shown in FIG. 3 and taken in the direction of arrow K.

A paper web train 6 can also consist of more than two paper webs 3, 4. Any possible lateral running out of true of the long edges 83 and 84 of the individual paper webs 3 and 4 is monitored by photoelectric cells 77 and 78, which each cooperates with a light source 79 or 81 that is connected to a suitable voltage U. As depicted in FIG. 4, the running out of true of even one of the paper webs 3 or 4 by a predeterminable amount is indicated since the current flow generated by the associated one of the photoelectric cells 77 or 78 will be disrupted. The photoelectric cells 77 and 78 are each connected by a voltage-pulse converter 61 or 62, by means of a cable 80 or 82 respectively with the computer 73, which triggers a trouble signal or causes an immediate stop of the machine if the web runs out of true. The photoelectric cells 77 and 78 as well as the light sources 79 and 81, which may be in the form of light-emitting diodes, are displaceably or shiftably secured to the frame either below or above the paper webs 3 and 4 and transversely to the plane of the movement direction C of the paper webs 3 and 4. This allows them to be adjusted in relation to the long edges 83 and 84 of the paper webs 3 and 4 in such a way that only after a lateral running out of true of a paper web 3 or 4 is a signal triggered in response to the disruption of the light beams being transmitted by the light source 79 or 81 to the photoelectric cells 77 or 78. Such changes in position can be caused by a tear in the paper web, for example.

Figure 5:
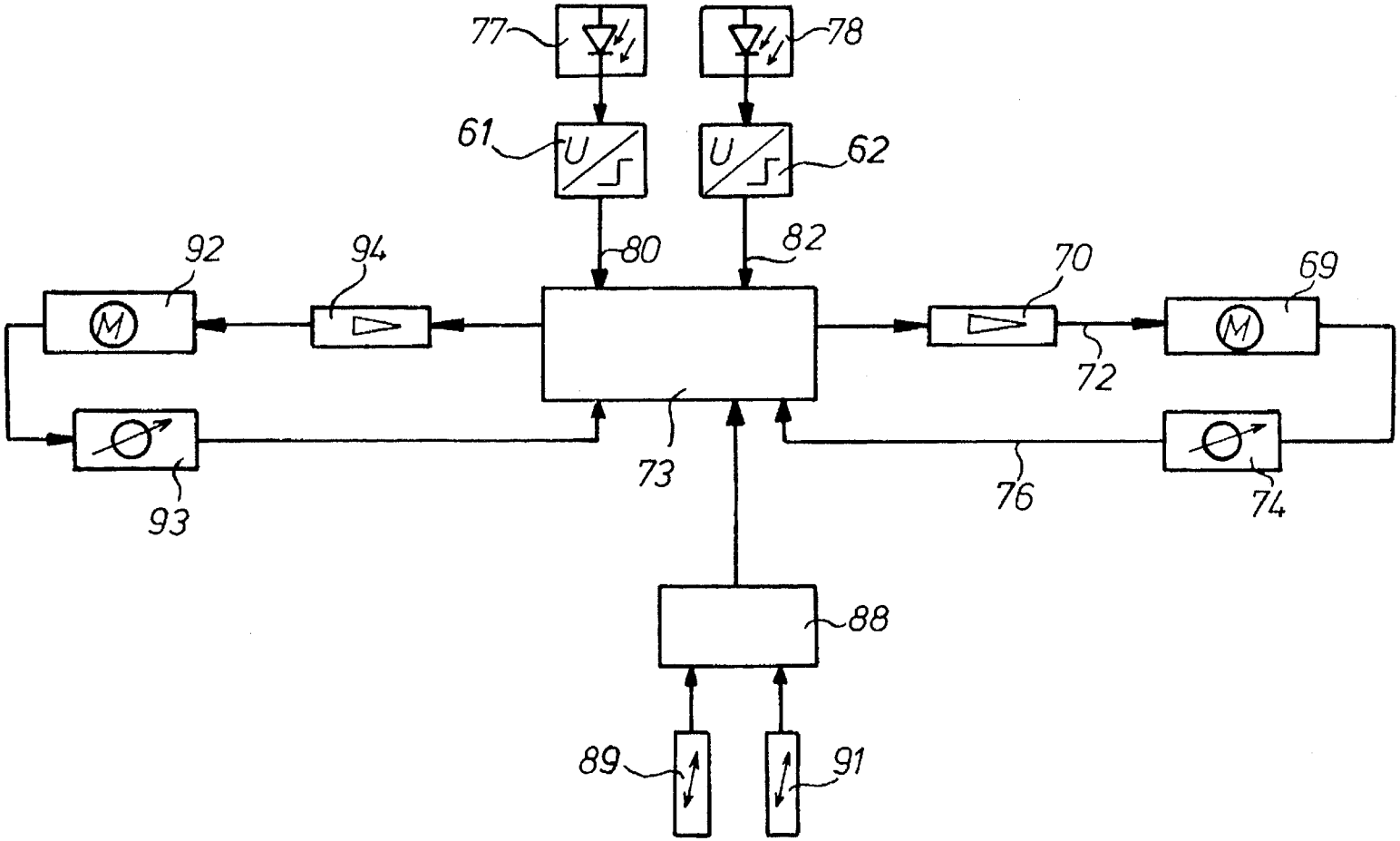
FIG. 5 is a block diagram for a computer controlled operating system for the folding apparatus of the present invention.

As depicted schematically in FIG. 5, parameters such as depicted as 89 and 91 can be entered by use of a keyboard 88, into the computer 73 and may contain such information as the paper webs widths "e" or "f" and an alternative stitching process being performed by means of the stitcher 19. The paper web width or the width of a signature 11 or 12 can vary between a maximum width "e" and a width which is less than the width "f" of the signature 11 or 12 represented in FIG. 2. As a function of the entered parameters 89 and 91, the turning bar 63 will be shifted by a program entered into the computer 73 within the displacement range "h" in the axial direction G by means of the motor 69 and gear 71 on the sliding guides 67 and 68. This web movement by an amount "b" will be in such a way that at least one long edge 83 or 84 of a signature 11 is covered by at least one-half of the width "b" of a belt 41 or 45. In this way the grippers 53 and 57 of the belt system 13 can grip the front edge of the signature 11 situated in the production direction C in such a way that when the grippers 53 and 57 grip again, the signature 11 is gripped at this point in an assured and damage-free way without the front edges being deformed. If it is additionally intended to stitch the signature, the signature will additionally be aligned or centered in the production direction C on the line 48, which is the center line of the collecting cylinder 16 by means of the program entered into the computer 73. Furthermore, the lateral limiter disks (not shown) of the paddle wheels 26 and 34 are adapted to the actual width "f" of the signature 11 or to its position with respect to the line 48. In a broader sense this also applies to the paddle wheel bodies 26, 37 arranged between the limiter disks. This is done by means of a gear motor 92. The actual position of the limiter disks is reported to the computer 73 by a potentiometer 93 fixed on the frame. The gear motor 92 is connected via an amplifier 94 with the computer 73 over lines not shown in detail. It will be understood that the parts 92, 93 and 94 are provided in duplicate and can be used for both the paddle wheel 26 as well as the paddle wheel 34.

Figure 6:
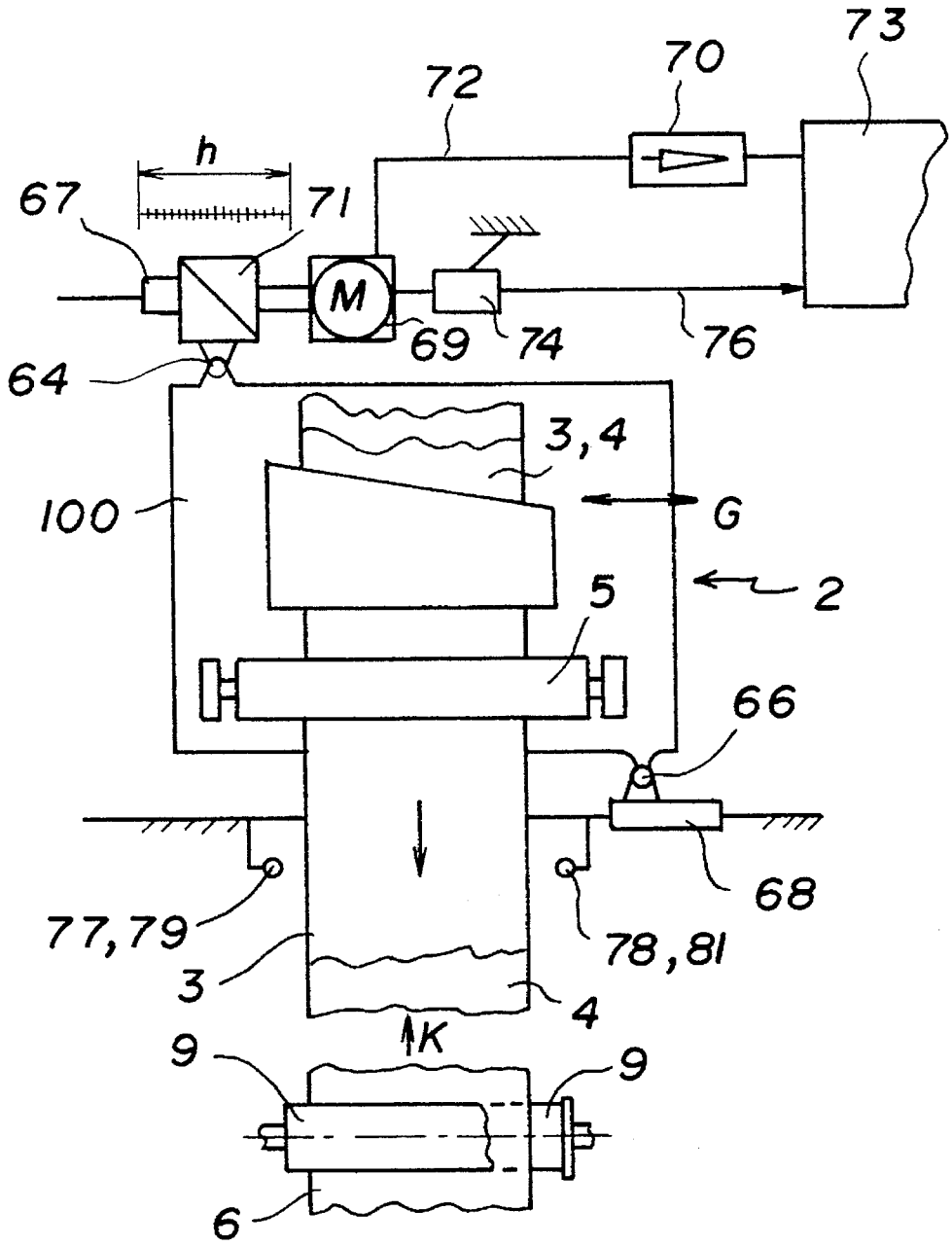
FIG. 6 is a schematic front elevation view of a portion of the folding apparatus and showing an axially displaceable longitudinal folding device.

A longitudinal folding device 2, having a pair of folding rollers 5 and being displaceable in the axial direction G, can also be disposed above the folding apparatus in place of a turning bar 63 displaceable in the axial direction G; as is depicted schematically in FIG. 1. In this case, the axes of rotation of the pair of folding rollers 5 that are disposed at the outlet of the former of the longitudinal folding device 2 extend parallel to the axis of rotation 39 of the collecting cylinder 16. The motor 69, amplifier 70, gear 71, potentiometer 74, together with a guide 100, as shown in FIG. 6, can be used for displacing the longitudinal folding device 2 and its associated folding rollers 5. The guide 100 can be designed analogously to the sliding guide 67 and 68, or consist of rails fixed on the frame on which the longitudinal folding device 2 and folding rollers 5 can be displaced by means of wheels.

It is possible, in accordance with the present invention, to provide the collecting cylinder 16 with a different division instead of five parts. This also applies to the folding jaw cylinder 20. It is also possible to execute the method of positioning signatures at a so-called "Cutt" apparatus, in connection with which the signatures are also guided by means of belts.

While a preferred embodiment of a folding apparatus in accordance with the present invention has been set forth fully and completely hereinabove, it will be apparent to one of skill in the art that a number of changes in, for example the overall sizes of the cylinders, the specific drive assemblies for the belt guide systems, the materials used for the belts and the like could be made without departing from the true spirit and scope of the present invention which is accordingly to be limited only by the following claims.

What is claimed is:

1. A folding apparatus for folding signatures in a printing machine, said folding apparatus comprising:

a collecting cylinder having signature gripper systems and folding blade systems and being rotatable about a central axis, said collecting cylinder having a peripheral surface with a maximum working width;

a folding jaw cylinder cooperating with said collecting cylinder to cross-fold signatures, said folding jaw cylinder having folding jaw systems;

a belt guide system having a plurality of spaced, parallel, driven guide belts, said guide belts each having a belt width, said belt guide system being in contact with said collecting cylinder and said folding jaw cylinder, each of said guide belts being spaced from adjacent ones of said guide belts in said guide belt system by a belt spacing less than said belt width;

a plurality of signatures to be folded, said signatures each having a signature width less than said maximum working width of said collecting cylinder; and means to displace said signatures in the direction of said axis of rotation of said collecting cylinder prior to engagement of said signatures with said signature gripper system an amount equal to at least said belt width of one of said guide belts.

2. A folding apparatus for folding signatures in a printing machine, said folding apparatus comprising:

a collecting cylinder having signature gripper systems and folding blade systems and being rotatable about a central axis, said collecting cylinder having a peripheral surface with a maximum working width;

a folding jaw cylinder cooperating with said collecting cylinder to cross-fold signatures, said folding jaw cylinder having folding jaw systems;

a belt guide system having a plurality of spaced, parallel, driven guide belts, said guide belts each having a belt width, said belt guide system being in contact with said collecting cylinder and said folding jaw cylinder;

a plurality of signatures to be folded, said signatures each having a signature width less than said maximum working width of said collecting cylinder;

a transverse cutting device and a paper web train, said transverse cutting device being located before, in the direction of travel of said paper web train, said collecting cylinder and being usable to transversely cut said paper web train into said plurality of signatures; and means to shift said paper web train and to displace said signatures in the direction of said axis of rotation of said collecting cylinder prior to engagement of said signatures with said signature gripper system an amount equal to at least said belt width of one of said guide belts, said means to shift said paper web train being a longitudinal folding device having a longitudinal former and folding rollers, said folding rollers having axes of rotation parallel to said axis of rotation of said collecting cylinder, said longitudinal folding device being supported for displacement in the direction of said axis of rotation of said collecting cylinder.

3. The folding apparatus of claim 2 further including a drive means in connection with a computer for accomplishing said axial displacement of said longitudinal folder.

* * * * *